United States Patent [19]

Morgan et al.

[11] 4,258,117

[45] Mar. 24, 1981

[54] DYE IMAGE REVERSAL PROCESSES AND IMAGE TRANSFER FILM UNITS

[75] Inventors: John Morgan, Ruislip; Peter D. Marsden, North Harrow, both of England

[73] Assignee: Eastman Kodak Company, Rochester, N.Y.

[21] Appl. No.: 90,230

[22] Filed: Nov. 1, 1979

[30] Foreign Application Priority Data

Feb. 9, 1979 [GB] United Kingdom ..... 4691/79

[51] Int. Cl.[3] ..... G03C 1/40; G03C 7/00; G03C 5/54; G03C 1/76

[52] U.S. Cl. ..... 430/214; 430/218; 430/236; 430/239; 430/242; 430/375; 430/379; 430/380; 430/390; 430/502; 430/505; 430/506; 430/509

[58] Field of Search ..... 430/214, 218, 236, 239, 430/242, 379, 380, 390, 375, 502, 505, 506, 509

[56] References Cited

U.S. PATENT DOCUMENTS

| | | | |
|---|---|---|---|
| 3,243,294 | 3/1966 | Barr | 430/379 |
| 3,619,156 | 11/1971 | Arai et al. | 430/379 |
| 3,647,452 | 3/1972 | Hendess et al. | 430/379 |
| 3,938,995 | 2/1976 | Gompf et al. | 430/379 |
| 3,998,637 | 12/1976 | Faul et al. | 430/379 |

FOREIGN PATENT DOCUMENTS 1464104 2/1977 United Kingdom .

*Primary Examiner*—Richard L. Schilling
*Attorney, Agent, or Firm*—Carl O. Thomas

[57] ABSTRACT

A method is disclosed of photographically processing a negative-working imagewise exposed silver halide photographic element to produce a reversal dye image comprising (a) developing the imagewise exposed silver halide with an electron transfer agent to produce oxidized electron transfer agent which reacts with a competing oxidizable substance and (b) developing silver halide remaining with the electron transfer agent in the presence of a dye image providing compound capable, after the competing oxidizable substance has been depleted, of reacting with the oxidized electron transfer agent to produce a reversal dye image. Image transfer film units are disclosed useful in the practice of this method. Such film units include those containing in addition to the competing oxidizable substance and initially immobile dye image providing compound a layer containing additional silver halide and a scavenger separating the additional silver halide from the immobile dye image providing compound.

20 Claims, No Drawings

DYE IMAGE REVERSAL PROCESSES AND IMAGE TRANSFER FILM UNITS

FIELD OF THE INVENTION

This invention relates to photographic dye image reversal processes of reproduction and, in particular, to color image transfer reversal processes.

BACKGROUND OF THE INVENTION

A reversal process of producing a positive dye image using as a dye image providing compound a redox dyereleaser, hereinafter also referred to simply as an RDR, and a negative-working silver halide emulsion is disclosed in Faul et al U.S. Pat. No. 3,998,637. After imagewise exposure the photographic element is developed without cross-oxidizing the RDR. The residual silver halide is then fogged, and a second development step is performed in which oxidized developing agent produced as a reaction product cross-oxidizes the RDR to permit a positive dye image to be formed. Gompf et al U.S. Pat. No. 3,938,995 and Faul et al U.K. Pat. No. 1,494,010 disclose essentially similar processes, except that the dye image providing compounds employed are, respectively, a leuco dye or a ballasted primary paraphenylenediamine. Silver halide developing agents used to cross-oxidize RDR's and other dye image providing compounds are also commonly referred to in the art as electron transfer agents, hereinafter also referred to as ETA's.

A direct reversal process for producing a positive dye image is disclosed in Hendess U.S. Pat. No. 3,647,452, wherein an imagewise exposed photographic element containing a negative-working silver halide emulsion and a dye-forming coupler is developed with a color developing agent in the presence of a competing coupler with which the oxidized color developing agent couples to form a diffusible or colorless reaction product. During continued development of residual, unexposed silver halide the competing coupler is exhausted or washed out of the material, so that the oxidized color developing agent can now couple with the dye-forming coupler to form a positive dye image.

Another color reversal process is described in Hinshaw et al U.K. Pat. No. 1,464,104, wherein a dye image providing compound is employed which releases a dye by an intramolecular nucleophilic displacement reaction at a relatively slow rate. The compound is capable of reacting more rapidly with an oxidized developing agent to prevent dye release by intramolecular nucleophilic displacement from occurring. In a preferred form intramolecular nucleophilic displacement is further delayed by employing a compound containing a hydrolyzable precursor of the nucleophilic group, thereby permitting further reduced minimum dye densities to be obtained. Direct color reversal processing can be undertaken, or, to achieve very low minimum dye densities, exposed silver halide can be developed in a first developer having a pH below that required to permit hydrolysis of the nucleophilic precursor, so that no dye is formed, while residual silver halide is developed in a second, higher pH developer so that dye is imagewise released.

A direct color reversal process is disclosed by Barr U.S. Pat. No. 3,243,294, wherein the photographic element contains a negative-working silver halide emulsion and physical development nuclei. Also incorporated in the element for black-and-white development is, in one form, a combination of a ballasted hydroquinone and a diffusible 3-pyrazolidone (also termed 3-pyrazolidinone). Upon imagewise exposure and development in the presence of a color developing agent exposed silver halide is preferentially developed by the 3-pyrazolidone and ballasted hydroquinone, so that no oxidized color developing agent and consequently no dye is produced in imagewise exposed areas. Subsequent physical development of the residual, unexposed silver halide does, however, produce oxidized color developing agent, so that a positive dye image is formed.

SUMMARY OF THE INVENTION

A reversal process is provided wherein negative-working silver halide photographic elements are employed, wherein an electron transfer agent is used to develop the silver halide in two development stages and wherein the formation of color is controlled by a competing oxidizable substance so that color formation can occur in only the second development stage.

In one aspect this invention is directed to a method of producing a reversal dye image by photographically processing an imagewise exposed photographic element containing at least one negative-working silver halide emulsion layer. The method comprises contacting the photographic element with an alkaline processing composition, at least one of the photographic element and the processing composition containing (a) an electron transfer agent which is oxidized in developing exposed silver halide, (b) a dye image providing compound and (c) a competing oxidizable substance which is cross-oxidized by the oxidized electron transfer agent in preference to the dye image providing compound. The competing oxidizable substance is present in an amount sufficient to regenerate substantially all of the electron transfer agent oxidized by development of imagewise exposed silver halide. The silver halide remaining which was not imagewise exposed is developed with the electron transfer agent to produce additional oxidized electron transfer agent, the competing oxidizable substance remaining is depleted without depleting the oxidized electron transfer agent, and the oxidized electron transfer agent reacts with the dye image providing compound to produce a reversal dye image.

The present invention is particularly applicable to direct dye image reversal processing--that is, processing which produces a reversal dye image and which employs a single developer or activator. The present invention is specifically applicable to obtaining reversal dye images in color image transfer systems.

In one specific, preferred aspect this invention is directed to an improvement in an image transfer film unit capable of producing a transferred dye image when imagewise exposed and photographically processed with an alkaline processing composition. The film unit comprises a photographic element having a support, a negative-working silver halide emulsion imaging layer on the support and, associated with the emulsion layer, an initially immobile negative-working dye image providing compound capable of providing a mobile image dye. An image-receiving means is positioned to receive the mobile image dye from the photographic element, and an electron transfer agent is located to develop silver halide and thereby produce oxidized electron transfer agent during processing.

The film unit is characterized by the improvement in which a competing oxidizable substance which is preferentially cross-oxidized by oxidized electron transfer agent is located to contact the oxidized electron transfer agent and is present in an amount sufficient to regenerate substantially all of the electron transfer agent oxidized by development of imagewise exposed silver halide. A layer is present containing additional silver halide which, when fogged, develops at a faster rate than silver halide present in the silver halide emulsion imaging layer. The additional silver halide is present in an amount sufficient to permit oxidized electron transfer agent produced by development of the additional silver halide to deplete by cross-oxidation the competing oxidizable substance. A processing composition permeable layer containing a scavenger separates the additional silver halide from the immobile dye image providing compound, so that mobile image dye is produced selectively by development of imagewise unexposed silver halide in the silver halide emulsion imaging layer following depletion of the competing oxidizable substance to produce a positive transferred dye image in the image receiving means.

DESCRIPTION OF PREFERRED EMBODIMENTS

It is preferred to employ a 3-pyrazolidinone developing agent as an electron transfer agent, such as 1-phenyl-3-pyrazolidinone, 4,4-dimethyl-1-phenyl-3-pyrazolidinone, 4,4-bis(hydroxymethyl)-1-phenyl-3-pyrazolidinone, 4,4-dimethyl-1-tolyl-3-pyrazolidinone, 4,4-dimethyl-1-xylyl-3-pyrazolidinone, 1,5-diphenyl-3-pyrazolidinone, and 4-hydroxymethyl-4-methyl-1-phenyl-3-pyrazolidinone. Other developing agents which are also well suited for use as electron transfer agents are p-aminophenol, catechol and p-phenylenediamine developing agents. Exemplary aminophenol developing agents include p-aminophenol, p-dibutylaminophenol, p-piperidinophenol, and 4-dimethylamino-2,6-dimethoxyphenol. Exemplary p-phenylenediamine developing agents include N-methyl-p-phenylenediamine, N-ethyl-p-phenylenediamine, N,N-dimethyl-p-phenylenediamine, 4-diethylamino-2,6-dimethoxyaniline, and, particularly, N,N,N',N'-tetraalkyl-p-phenylenediamine developing agents (e.g., N,N,N',N'-tetramethyl-p-phenylenediamine). Other electron transfer agents heretofore employed in combination with known dye image providing compounds can, of course, be employed.

The competing oxidizable substance can be any compound with which the electron transfer agent (ETA) in its oxidized form will react in preference to the dye image providing compound, thereby preventing or substantially reducing oxidation of the dye image providing compound. Preferably the competing oxidizable substance is substantially colorless in both its reduced and oxidized forms. A number of developing agents which under contemplated conditions of use are not themselves electron transfer agents are known to react preferentially with oxidized electron transfer agent in the presence of dye image providing compounds and can be employed. Such developing agents are disclosed in Faul et al U.S. Pat. No. 3,998,637, Gompf et al U.S. Pat. No. 3,938,995, Chasman et al U.S. Pat. No. 4,138,389 and Faul et al U.K. Pat. No. 1,494,010, the disclosures of which are here incorporated by reference.

Preferably the combination of ETA and competing oxidizable substance forms a superadditive developer. Such a combination can be achieved using a hydroquinone as a competing oxidizable substance and a 1-phenyl-3-pyrazolidinone as an ETA. The hydroquinone is preferably lower (1–4 carbon atoms) alkyl substituted.

Other combinations of ETA and competing oxidizable substance include a 1-phenyl-3-pyrazolidinone as an ETA and ascorbic acid, piperidino hexose reductone, t-butylhydroquinone or glycin as a competing oxidizable substance. The 1-phenyl-3-pyrazolidinone can be, for example, 1-phenyl-4-hydroxymethyl-4-methyl-3-pyrazolidinone. Another combination is catechol, as the ETA, and ascorbic acid, as the competing oxidizable substance.

Both the competing oxidizable substance and the ETA can be incorporated either in the developer or the photographic element. The competing oxidizable substance is present in a concentration sufficient to prevent oxidized ETA produced by a first stage of development—that is, development of imagewise exposed silver halide—from reacting with any dye image providing compound. The competing oxidizable substance is thus present in an amount at least sufficient, preferably just sufficient, to reduce substantially all oxidized ETA produced in the first stage of development.

In developing silver halide, the electron transfer agent is oxidized, but is regenerated by cross-oxidation with the competing oxidizable substance and, in a subsequent reversal or second stage of development, is regenerated by the dye image providing compound. Since ETA is not consumed in use, it is apparent that the ETA can be effective in very small amounts, although amounts of ETA commonly employed in developers and incorporated in photographic elements are generally useful. It is preferred to employ ETA in the developer in a concentration in the range of from 0.1 to 10 grams per liter, most preferably, 0.2 to 2 grams per liter. When the ETA is incorporated in the photographic element, it is preferably present in a concentration of from 0.1 to 10 grams/meter$^2$, most preferably from 0.2 to 2 grams/meter$^2$. Optimum concentrations of the competing oxidizable substance and the ETA for a specific application can be identified by routine adjustment procedures.

In the processes of the present invention it is not necessary to wash out the residual competing oxidizable substance before commencing the second development stage. On the other hand, the concentration of competing oxidizable substance in the residual silver halide areas must be limited or lowered relative to the concentration of imageforming residual silver halide so that enough oxidized ETA is produced to form a satisfactory reversal image.

In the processes of the present invention the amount of competing oxidizable substance present in the second development stage can be limited by removing the photographic element from the developer and effecting the second development without introducing any more of the competing oxidizable substance. The limited amount of competing oxidizable substance is soon used up in the residual silver halide areas; and a positive image will be formed given sufficient residual silver halide. Additional ETA can be supplied for the second, reversal development stage, although this is not necessary.

The amount of competing oxidizable substance remaining in the residual silver halide areas can be conveniently lowered by means which tend to lower the amount of the competing oxidizable substance in the processed material in a nonimagewise manner—e.g., uniformly. Preferably the means is sufficient to lower the highest concentration of the competing oxidizable substance, which is in completely unreduced areas of silver halide, to zero or close to zero. (It does not matter if the amount of competing oxidizable substance in the initially exposed areas remains high.) Thus, the amount of competing oxidizable substance can be lowered by absorption in a mordant layer. This can be done by laminating a receiver having an absorbent mordant-containing layer to the photographic element after the first development. This method of lowering the amount of the oxidizable substance is convenient in the preferred embodiments of the invention wherein a diffusible dye or dye precursor is formed in the second development stage any diffuses to a receiver layer to produce a transferred image, since the receiver can provide the absorbent layer. Additional ETA may be incorporated into such layer and allowed to diffuse into the silver halide layer or layers of the photographic element during the second development stage.

Even if the receiver does not remove any substantial amount of residual competing oxidizable substance from the negatively developed material, the finite amount of the competing oxidizable substance left in the photographic element is soon used up in the course of the second stage of development, and a positive dye image is then formed, provided there is sufficient developable silver halide remaining.

Thus, to carry out this embodiment of the invention, all that is required is to develop the imagewise exposed silver halide in a developer containing an ETA and a competing oxidizable substance, then to laminate the developed photographic element to a receiver and to allow the second stage of development to occur in which unexposed, residual silver halide is developed. The residual silver halide becomes developable following extended contact with the developer. Preferably the photographic element is fogged immediately prior to the second development stage to accelerate development of the residual silver halide.

The electron transfer agent (ETA), when in the photographic element or in the receiver, can be chemically blocked in such a manner that it only becomes active as a developer on reacting with alkali. Slow release of the ETA thus obtained enhances discrimination, which is especially valuable in an integral format process. Chemically blocked ETA's are disclosed in Mooberry et al U.S. Ser. No. 949,462, filed Oct. 10, 1978, commonly assigned, the disclosure of which is here incorporated by reference.

Conventional silver halide solvents, such as those normally used in reversal processing for lowering the minimum density ("cleaning out" the toe) of a reversal characteristic curve may be used in this system. Such silver halide solvents include thiocyanates, thioethers and pyridinium salts, such as disclosed in McBride U.S. Pat. No. 3,271,157, Nietz et al U.S. Pat. No. 2,222,264, Lowe et al U.S. Pat. No. 2,448,534, Illingsworth U.S. Pat. No. 3,320,069 and Welliver et al U.S. Pat. No. 2,648,604.

Another method of lowering the amount of competing oxidizable substance for the second development stage involves providing additional silver halide, preferably in an amount sufficient to produce the quantity of oxidized ETA needed to oxidize all the competing oxidizable substance remaining in the residual silver halide areas of the image-forming silver halide. The additional silver halide may be in an image-forming silver halide layer or in another layer. "Additional silver halide" is herein defined as silver halide over and above that required to produce a maximum dye density in the absence of the competing oxidizable substance.

The additional silver halide is rendered developable (fogged) at the same time as the residual, image-forming silver halide. If a chemical foggant is used to make the silver halide developable, the foggant may be incorporated in the photographic element or in a receiver or in a cover sheet, in a dye image transfer process. A timing layer and/or a hydrolyzable blocking group may be used to delay the action of the foggant.

The use of additional silver halide in a negative-working silver halide emulsion layer to be imagewise exposed (i.e.—a silver halide emulsion imaging layer) can be illustrated by reference to a form of the process described above in which the photographic element is placed in a developer containing at least the competing oxidizable substance for the first development stage and is thereafter removed from the developer and placed in contact with a receiver. In this form the competing oxidizable substance is not appreciably depleted by the cross-oxidizing action of oxidized ETA during the first development stage, since replenishment of the competing oxidizable substance from the developer occurs. Thus, at the beginning of the second development stage, in which development of residual silver halide commences, the oxidized ETA produced as a reaction product must first consume the competing oxidizable substance present before it can cross-oxidize the image dye providing compound. The additional silver halide in the negative-working silver halide emulsion layer can be developed in either the first or second development stage in imagewise exposed areas. In imagewise unexposed areas the additional silver halide develops in the second development stage and depletes the competing oxidizable substance. Development of the residual silver halide then produces oxidized ETA, which cross-oxidizes the dye image providing compound in initially unexposed areas.

The use of additional silver halide in a separate silver halide emulsion layer separated by a scavenger-containing layer from the negative-working silver halide emulsion imaging layer and image dye providing compound can be illustrated by reference to an integral dye image transfer unit comprised of a photographic element, a receiver, a processing composition (e.g., a developer) and a container for releasing the processing composition (e.g., a pod). Specifically, in the application of this invention to integral format (e.g., in-camera) processing, the competing oxidizable substance becomes available in its entirety at the commencement of the first development stage. Typically this occurs when the developer is released from a pod and spread between the photographic element portion of the unit and the integral receiver. At least enough, preferably just enough, competing oxidizable substance is present to react with all of the silver halide developed in areas receiving a maximum light exposure, thereby preventing oxidation of dye image providing compound during the first development stage. But this means that (in the absence of additional silver halide) there is enough competing oxidizable substance to react with all the silver halide in the initially unexposed areas of the photographic element during the second development stage as well. To deplete the residual unoxidized competing oxidizable substance remaining at the end of the first development stage, a separate layer of additional or sacrificial silver halide is provided separated from the dye image providing compound by a scavenger layer. In one preferred form the extra silver halide layer and scavenger layer are coated in that order over the conventional layers of a receiver. In one alternative form the additional silver halide in the sacrificial layer can be fogged and separated from the image dye providing compound by a timing layer.

In the second development stage the sacrificial silver halide layer develops more rapidly than the residual silver halide in the emulsion imaging layer. The ETA which develops the extra silver halide in the sacrificial layer becomes oxidized and cross-oxidizes the competing oxidizable substance. In this way the competing oxidizable substance is depleted before development of residual silver halide in the emulsion imaging layer commences. This allows the residual silver halide to be used in its entirety to react through the ETA with the dye image providing compound and thus enables maximum dye densities to be formed in initially unexposed areas which are not reduced by the presence of competing oxidizable substance. At the same time the scavenger layer insures that minimum dye densities are not increased in areas initially receiving full light exposure. The scavenger insures that no reaction of oxidized ETA produced by development of the additional silver halide occurs with the dye image providing compound, since the two are separated by the scavenger layer.

The scavenger layer can take the form of conventional scavenger interlayers in multicolor photographic elements. Such layers typically include a hydrophilic colloid vehicle, such as gelatin, which contains an immobile oxidizable substance, such as a ballasted hydroquinone. The scavenger can, alternatively, be incorporated in the extra silver halide emulsion layer, if desired, or in a combination of both locations. Illustrative of scavengers useful as interlayers in the multicolor photographic elements used in the practice of this invention and to scavenge oxidized electron transfer agent as described above are those of Weissberger et al U.S. Pat. No. 2,336,327, Loria et al U.S. Pat. No. 2,728,659, Vittum et al U.S. Pat. No. 2,360,290, Jelley et al U.S. Pat. No. 2,403,721 and Thirtle et al U.S. Pat. No. 2,701,197. To avoid autooxidation the scavengers can be employed in combination with other antioxidants, as illustrated by Knechel et al U.S. Pat. No. 3,700,453.

The additional silver halide layer is preferably clean-working—i.e., it produces a low minimum density or fog level when developed without prior exposure or fogging. To ensure development during the second stage of development, the additional silver halide develops more rapidly during the second development stage than the image-forming silver halide.

The additional silver halide layer can be located on either side of the image-forming silver halide layers. If on the exposure side of the image-forming layers then it should be fine-grained to avoid light-scattering. The uniformly fogged extra silver halide can be brought into developer permeable relationship with the image-forming silver halide after the first development. Thus the additional silver halide may be coated on a cover sheet. If the additional silver halide is coated on a receiver, subsequent removal of the developed silver by bleaching or stripping the layer is usually desirable.

The provision of the additional silver halide in a separate layer that is not part of the normal image-forming silver halide layer structure is particularly suitable for the application of the invention to an incamera integral system.

Preferably, in this invention all the residual silver halide is reduced to silver in the second development stage in order to achieve maximum dye formation and density. The photographic element can be heated to achieve this or to complete image formation sooner. If the photographic element is so heated, this can supplement or replace the chemical foggant or light exposure used to accelerate residual silver halide development.

In the present invention, since it is usually desirable to reduce all the residual silver halide, it is not necessary to stop development. This is in contrast to color diffusion transfer processes wherein a diffusible dye is liberated in alkaline developer following oxidation of the image dye providing compound by oxidized developing agent and wherein fog is formed if development is not stopped.

The photographic elements described above for use in this invention can exhibit sufficient flexibility to permit their use as so-called "universal" materials. That is, they can be made to produce negative images instead of positive images and can be processed to produce either high or low contrast images. For example, by omitting or preliminarily depleting the competing oxidizable substance, negative dye images can be produced. Further, by proper selection of characteristic curve shape for the silver halide layers and selection of the portion of the characteristic curve employed for imaging, it is possible to obtain either high or low contrast images. For example, if the silver halide layers exhibit lower contrast at the higher exposure end of the characteristic curve, an overall flash exposure of a photographic element prior to imagewise exposure can effectively shift imaging to the higher exposure end of the characteristic curve to produce a lower contrast reversal dye image.

The process of the present invention can be applied to the production of reversal color images using any dye image providing compound which in response to an imagewise distribution of ETA and oxidized ETA permits a dye image to be formed. Preferred dye image providing compounds are those which react with oxidized ETA to form a dye or dye precursor, which dye or dye precursor can be diffusible or immobile. Specifically preferred dye image providing compounds are initially immobile. Further, they are preferably reducing agents capable of cross-oxidizing with oxidized ETA to produce a dye image. For example, a color developing agent can be cross-oxidized by an oxidized ETA and couple with a dye-forming coupler to form an image dye. Either or both of the color developing agent and color coupler can be viewed as a dye image providing compound. Alternatively, the dye image providing compound can initially be a dye or leuco dye and exhibit an alteration in color or mobility, such as by cleavage as a function of oxidation. Such compounds include redox dye-releasers and are associated with the silver halide emulsion imaging layer in the layer itself or in an adjacent layer.

The present invention can be used to produce reversal images using color-developing agents and, for example, dye-forming couplers. The invention can be used for the preparation of transparencies and in integral image transfer systems. By the use of negative-working silver halide emulsions for making transparencies according to this invention fog formation can be avoided.

In one preferred form the photographic elements contain dye image providing compounds which produce dye images through the selective formation of dyes, such as by reacting (coupling) a color-developing aget (e.g., a primary aromatic amine) in its oxidized form with a dye-forming coupler. The dye-forming couplers can be incorporated in the photographic elements, as illustrated by Schneider et al, *Die Chemie,* Volume 57, 1944, page 113; Mannes et al, U.S. Pat. No. 2,304,940; Martinez, U.S. Pat. No. 2,269,158; Jelley et al, U.S. Pat. No. 2,322,027; Frolich et al, U.S. Pat. No. 2,376,679; Fierke et al, U.S. Pat. No. 2,801,171; Smith, U.S. Pat. No. 3,748,141; Tong, U.S. Pat. No. 2,772,163; Thirtle et al, U.S. Pat. No. 2,835,579; Sawdey et al, U.S. Pat. No. 2,533,514; Peterson, U.S. Pat. No. 2,353,754; Seidel, U.S. Pat. No. 3,409,435; and Chen, *Research Disclosure,* Volume 159, July 1977, Item 15930. *Research Disclosure* is published by Industrial Opportunities Ltd., Homewell, Havant Hampshire, PO9 1EF, United Kingdom.

In one form, the dye-forming couplers are chosen to form subtractive primary (i.e., yellow, magenta and cyan) image dyes and are nondiffusible, colorless couplers, such as two- and four-equivalent couplers of the open chain ketomethylene, pyrazolone, pyrazolotriazole, pyrazolobenzimidazole, phenol and naphthol type hydrophobically ballasted for incorporation in high-boiling organic (coupler) solvents. Such couplers are illustrated by Salminen et al, U.S. Pat. Nos. 2,423,730; 2,772,162; 2,895,826; 2,710,803; 2,407,207; 3,737,316; and 2,367,531; Loria et al, U.S. Pat. Nos. 2,772,161; 2,600,788; 3,006,759; 3,214,437; and 3,253,924; McCrossen et al, U.S. Pat. No. 2,875,057; Bush et al, U.S. Pat. No. 2,908,573; Gledhill et al, U.S. Pat. No. 3,034,892; Weissberger et al, U.S. Pat. Nos. 2,474,293; 2,407,210; 3,062,653; 3,265,506; and 3,384,657; Porter et al, U.S. Pat. No. 2,343,703; Greenhalgh et al, U.S. Pat. No. 3,127,269; Feniak et al, U.S. Pat. Nos. 2,865,748; 2,933,391; and 2,865,751; Bailey et al, U.S. Pat. No. 3,725,067; Beavers et al, U.S. Pat. No. 3,758,308; Lau, U.S. Pat. No. 3,779,763; Fernandez, U.S. Pat. No. 3,785,829; U.K. Pat. No. 969,921; U.K. Pat. No. 1,241,069; U.K. Pat. No. 1,011,940; Vanden Eynde et al, U.S. Pat. No. 3,762,921; Beavers, U.S. Pat. No. 2,983,608; Loria, U.S. Pat. Nos. 3,311,476; 3,408,194; 3,458,315; 3,447,928; and 3,476,563; Cressman et al, U.S. Pat. No. 3,419,390; Young, U.S. Pat. No. 3,419,391; Lestina, U.S. Pat. No. 3,519,429; U.K. Pat. No. 975,928; U.K. Pat. No. 1,111,554; Jaeken, U.S. Pat. No. 3,222,176 and Canadian Pat. No. 726,651; Schulte et al, U.K. Pat. No. 1,248,924; and Whitmore et al, U.S. Pat. No. 3,227,550.

The dye-forming couplers upon coupling can release photographically useful fragments, such as development inhibitors or accelerators, bleach accelerators, developing agents, silver halide solvents, toners, hardeners, fogging agents and competing couplers. Development inhibitor-releasing (DIR) couplers are illustrated by Whitmore et al, U.S. Pat. No. 3,148,062; Barr et al, U.S. Pat. No. 3,227,554; Barr, U.S. Pat. No. 3,733,201; Sawdey, U.S. Pat. No. 3,617,291; Groet et al, U.S. Pat. No. 3,703,375; Abbott et al, U.S. Pat. No. 3,615,506; Weissberger et al, U.S. Pat. No. 3,265,506; Seymour, U.S. Pat. No. 3,620,745; Marx et al, U.S. Pat. No. 3,632,345; Mader et al, U.S. Pat. No. 3,869,291; U.K. Pat. No. 1,201,110; Oishi et al, U.S. Pat. No. 3,642,485; Verbrugghe, U.K. Pat. No. 1,236,767; Fujiwhara et al, U.S. Pat. No. 3,770,436; and Matsuo et al, U.S. Pat. No. 3,808,945. DIR compounds which do not form dye upon reaction with oxidized color-developing agents can be employed, as illustrated by Fujiwhara et al, German OLS No. 2,529,350 and U.S. Pat. Nos. 3,928,041; 3,958,993; and 3,961,959; Odenwalder et al, German OLS No. 2,448,063; Tanaka et al, German OLS No. 2,610,546; Kikuchi et al, U.S. Pat. No. 4,049,455; and Credner et al, U.S. Pat. No. 4,052,213. DIR compounds which oxidatively cleave can be employed, as illustrated by Porter et al, U.S. Pat. No. 3,379,529; Green et al, U.S. Pat. No. 3,043,690; Barr, U.S. Pat. No. 3,364,022; Duennebier et al, U.S. Pat. No. 3,297,445; and Rees et al, U.S. Pat. No. 3,287,129.

When the invention produces reversal images using dye-forming couplers, the particular photographic elements described in the patents cited above describing dye-forming couplers can be used, for example. Such elements can be processed by developing with an ETA and a noncoupling (i.e., black-and-white) developing agent (which functions as a competing oxidizable substance) followed by lamination with a sheet having coated thereon a layer containing a color-developing agent. The element can be fogged either before or after lamination. Preferably the sheet and coating are transparent and the element is light fogged through the sheet and coating. After fogging, the noncoupling developing agent becomes exhausted and the oxidized ETA cross-oxidizes the color-developing agent. Subsequent delamination, bleaching and fixing gives a positive dye image. Alternatively, an immobile color-developing agent can be incorporated in the photographic element, as described in U.K. Pat. No. 1,494,010, cited above. The sheet carrying color-developing agent can additionally carry a timing layer and a bleach-fix composition, so that subsequent delamination is unnecessary.

This invention is particularly useful in color image transfer processes. Color image transfer film units (or systems) can be employed of the type illustrated by *Research Disclosure,* Volume 151, November 1976, Item 15162, and Volume 123, July 1974, Item 12331. Color image transfer systems (including silver halide layers, receiving layers, timing layers, acid layers, processing compositions, supports and cover sheets) and the images they produce can be varied by choosing among a variety of features, combinations of which can be used together as desired.

Film units can be chosen which are either integrally laminated or separated during exposure, processing and/or viewing, as illustrated by Rogers, U.S. Pat. No. 2,983,606; Beavers et al, U.S. Pat. No. 3,445,228; Whitmore, Canadian Pat. No. 674,082; Friedman et al, U.S. Pat. No. 3,309,201; Land, U.S. Pat. Nos. 2,543,181; 3,053,659; 3,415,644; 3,415,645; and 3,415,646; and Barr et al, U.K. Pat. No. 1,330,524.

A variety of approaches are known in the art for obtaining transferred dye images. Transferred dye images are obtained by altering the initial mobility of dye image providing compounds. (Initial mobility refers to the mobility of the dye image providing compound when it is contacted by the processing solution. Initially mobile dye image providing compounds as coated do not migrate prior to contact with processing solution.)

In image transfer, dye image providing compounds are classified as either positive-working or negative-working. Positive-working dye image providing compounds are those which produce a positive transferred dye image when employed in combination with a conventional, negative-working silver halide emulsion. Negative-working dye image providing compounds are those which produce a negative transferred dye image when employed in combination with conventional, negative-working silver halide emulsions. (The foregoing definitions assume the absence of special image reversing techniques, such as that of the present process or those referred to in *Research Disclosure*, Vol. 176, December 1978, Item 17643, paragraph XXIII-E.) When, as in the present invention, the silver halide emulsions are negative-working emulsions, negative-working dye image providing compounds produce positive transferred dye images because of the reversal capability of this process.

Image transfer systems, which include both the dye image providing compounds and the silver halide emulsions, are positive-working when the transferred dye image is positive and negative-working when the transferred dye image is negative. When a retained dye image is formed, it is opposite in sense to the transferred dye image. (These definitions are independent of special internal reversal techniques.)

A variety of dye image providing compounds are known and can be employed in the practice of this invention. One approach is to employ ballasted dye-forming (chromogenic) or non-dye-forming (non-chromogenic) couplers having a mobile dye attached at a coupling-off site. Upon coupling with an oxidized color developing agent, such as a para-phenylenediamine, the mobile dye is displaced so that it can transfer to a receiver. Such negative-working dye image providing compounds are illustrated by Whitmore et al, U.S. Pat. No. 3,227,550; Whitmore, U.S. Pat. No. 3,227,552; and Fujiwhara et al, U.K. Pat. No. 1,445,797, the disclosures of which are here incorporated by reference.

In a preferred image transfer system according to this invention employing as negative-working dye image providing compounds redox dye-releasers, the electron transfer agent develops silver halide and then cross-oxidizes with a compound containing a dye linked through an oxidizable sulfonamido group, such as a sulfonamidophenol, sulfonamidoaniline, sulfonamidoanilide, sulfonamidopyrazolobenzimidazole, sulfonamidoindole or sulfonamidopyrazole. Following cross-oxidation, hydrolytic deamidation cleaves the mobile dye with the sulfonamido group attached. Such systems are illustrated by Fleckenstein, U.S. Pat. Nos. 3,928,312 and 4,053,312; Fleckenstein et al, U.S. Pat. No. 4,076,529; Melzer et al, U.K. Pat. No. 1,489,694; Deguchi, German OLS No. 2,729,820; Koyama et al, German OLS No. 2,613,005; Vetter et al, German OLS No. 2,505,248; and Kestner et al, *Research Disclosure*, Volume 151, November 1976, Item 15157. Also specifically contemplated are otherwise similar systems which employ an immobile, dye-releasing (a) hydroquinone, as illustrated by Gompf et al U.S. Pat. No. 3,698,897 and Anderson et al U.S. Pat. No. 3,725,062; (b) para-phenylenediamine, as illustrated by Whitmore et al Canadian Pat. No. 602,607; (c) quaternary ammonium compound, as illustrated by Becker et al, U.S. Pat. No. 3,728,113.

In another specifically contemplated dye image transfer system which employs negative-working dye image providing compounds an oxidized electron transfer agent or, specifically, in certain forms, an oxidized para-phenylenediamine reacts with a ballasted phenolic coupler having a dye attached through a sulfonamido linkage. Ring closure to form a phenazine releases mobile dye. Such an imaging approach is illustrated by Bloom et al U.S. Pat. Nos. 3,443,939 and 3,443,940 and is useful in the practice of this invention.

In still another image transfer system employing negative-working dye image providing compounds useful in the practice of this invention, ballasted sulfonylamidrazones, sulfonylhydrazones or sulfonylcarbonylhydrazides can be reacted with oxidized para-phenylenediamine to release a mobile dye to be transferred, as illustrated by Puschel et al U.S. Pat. Nos. 3,628,952 and 3,844,785. In an additional useful image transfer system, a hydrazide can be reacted with silver halide having a developable latent image site and thereafter decompose to release a mobile, transferable dye, as illustrated by Kohara et al *Bulletin Chemical Society of Japan*, Volume 43, pages 2433 through 2437; and Lestina et al *Research Disclosure*, Volume 28, December 1974, Item 12832.

Image transfer systems employing negative-working dye image providing compounds are also known and useful in the practice of this invention in which dyes are not initially present, but are formed by reactions occurring in the photographic element or receiver following exposure. For example, a ballasted coupler can react with color developing agent to form a mobile dye, as illustrated by Whitmore et al U.S. Pat. No. 3,227,550, Whitmore U.S. Pat. No. 3,227,552, Bush et al U.S. Pat. No. 3,791,827 and Viro et al U.S. Pat. No. 4,036,643. An immobile compound containing a coupler can react with oxidized para-phenylenediamine to release a mobile coupler which can react with additional oxidized para-phenylenediamine before, during or after release to form a mobile dye, as illustrated by Figueras et al U.S. Pat. No. 3,734,726 and Janssens et al German OLS 2,317,134. In another form, a ballasted amidrazone reacts with an electron transfer agent as a function of silver halide development to release a mobile amidrazone which reacts with a coupler to form a dye at the receiver, as illustrated by Ohyama et al U.S. Pat. No. 3,933,493.

An image to be viewed can be transferred from the image-forming layers in practicing this invention. A useful retained image can also be formed for viewing as a concurrently formed complement of the transferred image. Positive transferred images and useful negative retained images can be formed with negative-working silver halide emulsions using the reversal process of this invention. Images retained in and transferred from the image-forming layers are illustrated by U.K. Pat. No. 1,456,413, Friedman U.S. Pat. No. 2,543,691, Bloom et al U.S. Pat. No. 3,443,940, Staples U.S. Pat. No. 3,923,510 and Fleckenstein et al U.S. Pat. No. 4,076,529.

Where mobile dyes are transferred to the receiver, a mordant is commonly present in a dye image providing layer. Mordants and mordant containing layers are described in the following references which are incorporated by reference: Sprague et al U.S. Pat. No. 2,548,564, Weyerts U.S. Pat. No. 2,548,575, Carroll et al U.S. Pat. No. 2,675,316, Yutzy et al U.S. Pat. No. 2,713,305, Saunders et al U.S. Pat. No. 2,756,149, Reynolds et al U.S. Pat. No. 2,768,078, Gray et al U.S. Pat. No. 2,839,401, Minsk U.S. Pat. Nos. 2,882,156 and 2,945,006, Whitmore et al U.S. Pat. No. 2,940,849, Condax U.S. Pat. No. 2,952,566, Mader et al U.S. Pat. No. 3,016,306, Minsk et al U.S. Pat. Nos. 3,048,487 and 3,184,309, Bush U.S. Pat. No. 3,271,147, Whitmore U.S. Pat. No. 3,271,148, Jones et al U.S. Pat. No. 3,282,699, Wolf et al U.S. Pat. No. 3,408,193, Cohen et al U.S. Pat. Nos. 3,488,706, 3,557,066, 3,625,694, 3,709,690, 3,758,445, 3,788,855, 3,898,088 and 3,944,424, Cohen U.S. Pat. No. 3,639,357, Taylor U.S. Pat. No. 3,770,439, Campbell et al U.S. Pat. No. 3,958,995 and Ponticello et al *Research Disclosure*, Vol. 120, April 1974, Item 12045, as well as Campbell et al U.S. Ser. No. 906,289, filed May 15, 1978, the disclosure of which is also here incorporated by reference.

One-step processing can be employed, as illustrated by U.K. Pat. No. 1,471,752, Land U.S. Pat. No. 2,543,181, Rogers U.S. Pat. No. 2,983,606 (pod processing) and Land U.S. Pat. No. 3,485,628 (soak image-former and laminate to receiver).

Preformed reflective layers can be employed, as illustrated by Whitmore Canadian Pat. No. 674,082, Beavers U.S. Pat. No. 3,445,228 Land U.S. Pat. Nos. 2,543,181, 3,415,644, 3,415,645 and 3,415,646 and Barr et al U.K. Pat. No. 1,330,524 or processing-formed reflective layers can be employed, as illustrated by Land U.S. Pat. Nos. 2,607,685 and 3,647,437, Rogers U.S. Pat. No. 2,983,606 and Buckler U.S. Pat. No. 3,661,585.

Generally, the image transfer film units in accordance with this invention and capable of producing a transferred dye image when imagewise exposed and photographically processed with an alkaline processing composition and comprise:

(1) a photographic element comprising a support having thereon at least one negative-working silver halide emulsion layer, the emulsion layer preferably having in contact therewith an image dye providing compound (which is preferably initially immobile and negative-working), (2) an image-receiving layer, which can be located on a separate support to form a separate receiver superposed or adapted to be superposed on the photographic element or which can be coated as a layer in the photographic element and (3) a competing oxidizable substance and an electron transfer agent each located to be present in the silver halide emulsion layer during processing, so that the processing composition, competing oxidizable substance, and electron transfer agent, when brought together, form a silver halide developer. In one form, the film units can contain the alkaline processing composition in a means, such as a pod, adapted to release the alkaline processing composition into contact with the emulsion layer.

In highly preferred embodiments, the film units of this invention contain a support having thereon a yellow dye image forming layer unit containing a blue-sensitive emulsion and in contact therewith a yellow dye image providing compound, a magenta dye image forming layer unit containing a green-sensitive silver halide emulsion and in contact therewith a magenta dye image providing compound, and a cyan dye image forming layer unit containing a red-sensitive silver halide emulsion and in contact therewith a cyan dye image providing compound preferably all of the dye image providing compounds are initially immobile.

The terms "diffusible" (or "mobile") and "immobile" (or "nondiffusible"), as used herein, refer to compounds which are incorporated in the photographic element and, upon contact with an alkaline processing solution, are substantially diffusible or substantially immobile, respectively, in the hydrophilic colloid layers of a photographic element.

The second development stage in the process of this invention stops of its own accord when the residual silver halide is fully reduced. It is not necessary to reduce the pH of the processing composition to stop development, as is the case in some color processes. Thus the complications of polymeric acid layers and precise timing layers which arise in integral image transfer systems are avoided. However, the pH of the layer or layers containing the dye image is preferably reduced so as to make the image more stable. This can be done at any time after image formation in any convenient manner—e.g., by means of a polymeric acid layer. If a timing layer is also employed, the requirements therefor are much less critical than for those involved with direct-positive emulsions, conventionally used in image transfer systems to produce positive transferred dye images using negative-working dye image providing compounds.

When the invention is applied to an integral image transfer system, the acid and timing layers are incorporated in their conventional positions to achieve the required reduction in pH. Typically they may lie adjacent a support, such as the photographic element support, receiver support or cover sheet.

During the first development stage the photographic element can be kept in the dark or the silver halide layers can be protected by a suitable black cover applied after imagewise exposure and peeled off at the start of the second development stage, allowing processing entirely in ambient light. A carbon layer can be located in the photographic element to lie behind the silver halide layers during imagewise exposure and thereby cooperate with the black cover to protect the silver halide layers from unwanted exposure during the first development stage.

Alternatively the invention can be practiced with silver halide layers coated over an additional silver halide layer and with a processing composition containing an opacifying agent. In one form of this embodiment of the invention a blocked chemical fogging agent is incorporated in the extra silver halide layer to assist the originally unexposed silver halide in developing. The blocked fogging agent can be a fogging agent derivative which is hydrolyzed at a controlled rate by the alkali of the processing composition to release the fogging agent. Instead of a blocked fogging agent an active fogging agent can be incorporated in a layer sufficiently remote from the silver halide layer (i.e., the layer which is to be fogged) or in a separate layer with a controlled permeation rate so that the fogging agent does not reach the silver halide until required. Alternatively a silver halide developer combination is used which commences development of unexposed silver halide after the first development stage as substantially completed.

In one specifically preferred embodiment of the process of the invention by which a color print or transparency containing a transferred dye image is obtained, a negative-working silver halide photographic element is prepared by coating red-sensitive, green-sensitive and blue-sensitive silver halide emulsion layers on a support, each emulsion layer containing or lying in contact with a redox dye-releaser of the complementary color. The element is imagewise exposed and developed in a developer containing a 1-phenyl-3-pyrazolidinone ETA and glycin. In the first developed areas the oxidized ETA oxidizes the glycin and is regenerated. Without further treatment the moist element is then laminated to a receiver containing a mordant layer and the element is fogged by light. The oxidized ETA first produced in the originally unexposed areas oxidizes the glycin present and thereafter, by reduction of more silver halide, effects release of the dyes which diffuse to the mordant layer to form a positive multicolor dye image transparency.

In an alternative application the imagewise exposed negative-working photographic element is developed with a solution containing a 1-phenyl-3-pyrazolidinone ETA and ascorbic acid. After development the moist element is laminated to a dry receiver containing additional ETA and fogged by light. On separating the receiver a positive transferred dye image is obtained. This process can also be carried out using a receiver which does not contain any ETA. In place of a 3-pyrazolidinone ETA, a catechol can be used and in place of ascorbic acid as a competing oxidizable substance a hexose reductone or glycin can be used. A thin mordant layer can be used over the silver halide emulsion layers to reduce stain, as described in *Research Disclosure*, Volume 162, November 1976, Item 16210.

As indicated above, the removal of oxidizable substance in the residual silver halide areas can be achieved by providing additional silver halide which on fogging and reduction by the ETA produces sufficient oxidized ETA for this purpose. In one specifically preferred embodiment of this process the additional silver halide is provided in a receiver, which comprises below the additional silver halide layer a carbon layer, a titanium dioxide layer and a mordant layer, the four layers being on a transparent support. A negative-working photographic element containing red-, green- and blue-sensitive silver halide emulsion layers and complementary RDR's as described above is exposed and developed in a viscous developer containing a 1-phenyl-3-pyrazolidinone ETA and a slowly diffusible lower alkyl substituted hydroquinone while laminated to the receiver. After the first development stage the laminate is light flashed and a positive transferred dye image is formed which is visible through the transparent receiver support.

Compared with the pH of developers used in direct-positive silver halide emulsions in image transfer systems, which typically exhibit a pH of 13.5 or higher, the pH which can be used in the second development stage of this invention can be as low as 10.6 (or even lower in some systems). Conventional higher pH levels can also be used in the second development stage. The first and second development stages normally employ a common activator or developer processing composition and are at the same pH levels.

The negative-working silver halide emulsions employed in the practice of this invention can be of any convenient conventional type. Preferred silver halide emulsions are silver bromoiodide and silver chlorobromoiodide emulsions, preferably having iodide contents of less than 10 mole percent, most preferably less than 6 mole percent, based on total halide. The negative-working silver halide emulsions can form predominantly surface latent images or internal latent images. The silver halide emulsions can be monodispersed or polydispersed; of coarse, medium or fine grain sizes, and of any convenient crystal habit. Lippmann emulsions are specifically contemplated for use in forming the extra silver halide layers. Suitable negative-working emulsions and methods for their preparation are disclosed in *Research Disclosure*, Vol. 176, December 1978, Item 17643, Sections I through IV, here incorporated by reference.

The negative-working photographic elements employed can be protected against instability tending to product fog or decrease maximum dye density by incorporation of stabilizers, antifoggants, antikinking agents, latent image stabilizers and similar addenda in the emulsion and contiguous layers prior to coating. Such addenda can also be incorporated in the processing compositions. Addenda of this type are illustrated by Section VI. The photographic elements, cover sheets and receivers can employ conventional photographic supports, including both film and paper supports, as illustrated by Section XVII. Other optional conventional photographic features not incompatible with the present invention are illustrated by Section V Brighteners, VIII Absorbing and scattering materials, IX Vehicles and vehicle extenders, X Hardeners, XI Coating aids, XII Plasticizers and lubricants, and XXI Development modifiers. The various addenda can be introduced in the emulsion and other layers of the photographic elements and receivers using conventional procedures, such as those described in Section XIV Methods of addition. The various layers of the elements employed can be coated as described in Section XV Coating and drying procedures. The photographic elements can be exposed by any of the techniques described in Section XVIII Exposure. These sections of *Research Disclosure*, Item 17643, cited above, are here incorporated by reference. The image transfer systems employed in this invention can contain any of the specific features described in *Research Disclosure*, Vol. 151, November 1976, Item 15162 (here incorporated by reference), not incompatible with the requirements of the image transfer systems described above. The layers of the photographic elements and image transfer film units, other than the supports and cover sheets, can be continuous or discontinuous. Discontinuous layers are illustrated by Rogers U.S. Pat. Nos. 2,681,857, 2,983,606 and 3,019,124; Whitmore U.S. Ser. No. 008,819, filed Feb. 2, 1979; and U.K. Pat. No. 1,318,371. Still other features of the elements, processing compositions and techniques for their use not specifically described will be readily apparent to those familiar with the photographic art.

The following examples further illustrate the present invention.

Preparation of Photographic Elements and Receivers (A) Three multilayer photographic elements, hereinafter designated PM No's. 1, 2 and 3, having the following structures were made. Unless otherwise stated, all coating coverages in the examples are reported parenthetically in terms of mg/m$^2$. Silver halide coverages are reported in terms of silver.

| PM No. 1 | |
|---|---|
| Layer 9: | Mordant X (150), gelatin (645) |
| Layer 8: | Blue-sensitive emulsion (430), scavenger (50), antifoggant (0.25 g/mole), gelatin (645) |
| Layer 7: | Yellow RDR(g) (575), gelatin (645) |
| Layer 6: | Scavenger (875), gelatin (645) |
| Layer 5: | Green-sensitive emulsion (430), gelatin (645) |
| Layer 4: | Magenta RDR(d) (550), gelatin (645) |
| Layer 3: | Scavenger (875), gelatin (645) |
| Layer 2: | Red-sensitive emulsion (480), gelatin (645) |
| Layer 1: | Cyan RDR(b) (450), gelatin (1500) |
| | Antihalation Support |

| PM No. 2 | |
|---|---|
| Layer 9: | Mordant X (125), gelatin (645) |
| Layer 8: | Blue-sensitive emulsion (430), scavenger (50), antifoggant (0.25 g/mole), gelatin (645) |

-continued

| PM No. 2 | |
|---|---|
| Layer 7: | Yellow RDR(f) (575), gelatin (645) |
| Layer 6: | Scavenger (875), gelatin (795) |
| Layer 5: | Green-sensitive emulsion (430), gelatin (645) |
| Layer 4: | Magenta RDR(c) (430), gelatin (645) |
| Layer 3: | Scavenger (1150), gelatin (1350) |
| Layer 2: | Red-sensitive emulsion (430), gelatin (645) |
| Layer 1: | Cyan RDR(a) (430), gelatin (1500) |
| | Antihalation Support |

| PM No. 3 | |
|---|---|
| Layer 9: | Mordant X (125), gelatin (645) |
| Layer 8: | Blue-sensitive emulsion (430), scavenger (40), antifoggant (0.25 g/mole), gelatin (645) |
| Layer 7: | Yellow RDR(h) (550), gelatin (645) |
| Layer 6: | Scavenger (875), gelatin (795) |
| Layer 5: | Green-sensitive emulsion (430), gelatin (645) |
| Layer 4: | Magenta RDR(e) (600), gelatin (645) |
| Layer 3: | Scavenger (875), gelatin (795) |
| Layer 2: | Red-sensitive emulsion (430), gelatin (645) |
| Layer 1: | Cyan RDR(b) (450), gelatin (1500) |
| | Antihalation Support |

The layers were hardened with bis(vinylsulfonylmethyl)ether (BVSME) in a concentration of 0.5 percent of their dry gelatin weight.

The compounds used in the above coatings are as follows:

Layer 1

Cyan RDR(a)

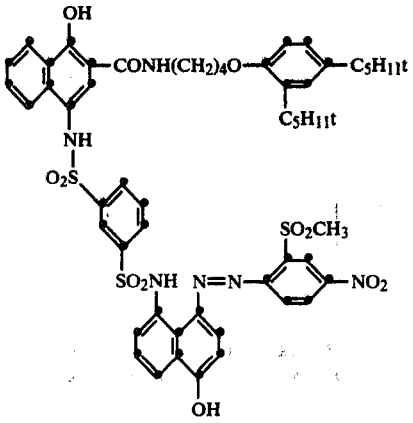

Coupler solvent, 1,4-cyclohexane dimethylene-bis-2-ethyl hexanoate (also present in layers 4 and 7) was used to disperse the RDR.

Cyan RDR(b)

-continued

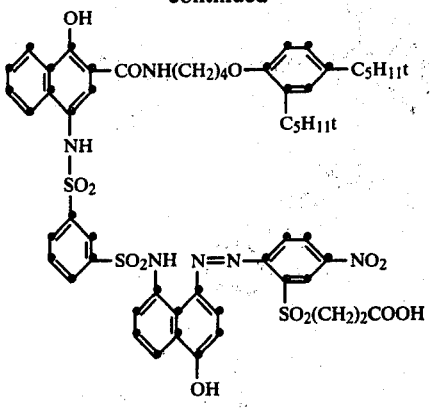

Layers 3, 6, and 8

Scavenger, di-dodecyl hydroquinone.

Layer 4

Magenta RDR(c)

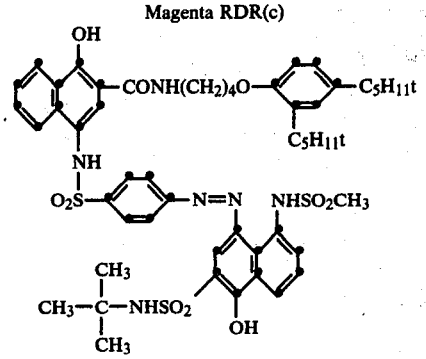

Magenta RDR(d)

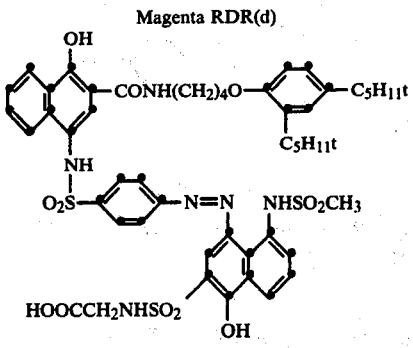

Magenta RDR(e)

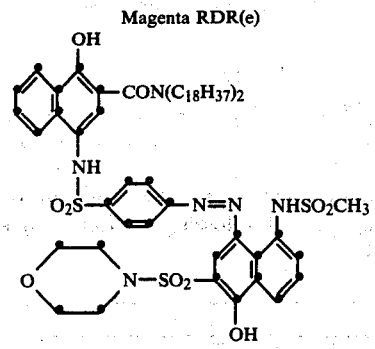

Layer 7

Yellow RDR(f)

-continued

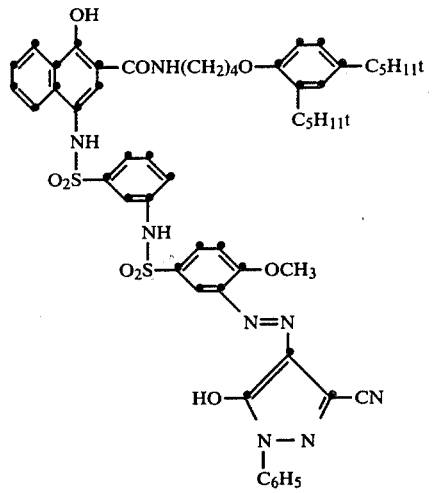

Yellow RDR(g)

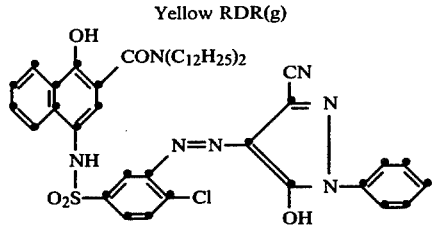

Yellow RDR(h)

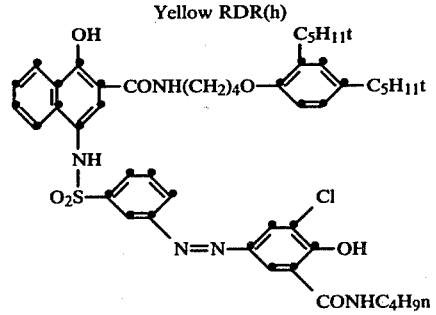

Layer 8

Antifoggant, 3'-(5-mercapto-1-tetrazolyl)-acetanilide sodium salt.

Layer 9

Mordant X: poly[styrene-co-(N-vinylbenzyl-N-benzyl-N,N-dimethyl)ammonium chloride-co-divinylbenzene].

Layers 2, 5 and 8

The emulsions used in layers 2, 5 and 8 were silver chlorobromides, red-, green- and blue-sensitized, respectively.

(B) Three mordant layer containing image-receivers, IRM's Nos. 1, 2 and 3, having the following structure were made:

| IRM No. 1 |
|---|
| Gelatin (2150), Mordant X (2150), HMMP* (81) Resin-coated Paper |

| IRM No. 2 |
|---|
| Gelatin (2150), Mordant X (2150), HMMP* (215) Resin-coated Paper |

| IRM No. 3 |
|---|
| Gelatin (2150), Mordant X (2150), Resin-coated Paper |

*HMMP above and hereinafter means 4-hydroxymethyl-4-methyl-1-phenyl-3-pyrazolidinone.

All three mordant coatings were hardened with bis(-vinylsulfonylmethyl)ether at 2 percent of the dry gelatin weight.

METHOD OF PROCESSING

The multilayer coatings were exposed using a color step wedge giving neutral, red, green, blue, cyan, magenta and yellow exposures. A dry receiver was hinged to the negative-working photographic element at one edge using a small strip of adhesive tape, and the exposed negative-working photographic element only was soaked in a developer solution (identified below) using a little agitation, the receiver being left dry. On completion of the first stage of development the negative-working element was removed from the developer solution, drained (approx. 5 seconds) and laminated with the attached dry receiver by passing the two sheets in register between a pair of stainless steel nip rollers. Light fogging was started immediately after lamination and was carried out by moving the laminate over a Photoflood lamp at a distance of approximately six inches, exposing each side for 20 seconds. The high intensity light source is necessary in order to fog the emulsion layers fully through the antihalation support of the negative-working photographic element and the resin-coated base of the receiver sheet, both of which have a high optical density. At the end of the second development stage the photographic element and receiver were peeled apart to reveal a transferred multicolor positive (reversal) dye image.

EXAMPLE 1—PM No. 3 and IRM No. 1

The exposed negative was developed for 1 minute at 23° C. (74° F.) with a little agitation in a solution of the following composition:

| Solution No. 1 | |
|---|---|
| Distilled water | 100 ml |
| Sodium hydroxide | 2.5 g |
| Potassium bromide | 0.50 g |
| 5-Methylbenzotriazole | 0.05 g |
| Sodium sulfite | 1.0 g |
| Ascorbic acid | 0.45 g |
| HMMP | 0.040 g |

After lamination in the manner described and light fogging for 40 seconds, the laminate was left together for 2 minutes before being peeled apart. Total process time was 3 minutes. On peeling apart, an excellent multicolor reversal dye image was obtained, $D_{min}$ Red 0.29, Green 0.33, Blue 0.32; $D_{max}$ Red 2.51, Green 2.15, Blue 2.20. There was no negative dye image visible in any of the colored wedges.

EXAMPLE 2—PM No. 2 and IRM No. 2

These coatings were processed as in Example 1, but using a solution of the following composition:

| Solution No. 2 | |
|---|---|
| Distilled water | 100 ml |
| Sodium hydroxide | 2.5 g |
| Potassium bromide | 0.50 g |
| 5-Methylbenzotriazole | 0.050 g |
| Sodium sulfite | 1.0 g |
| Ascorbic acid | 0.45 g |
| Catechol | 0.080 g |

An excellent multicolor reversal dye image was obtained.

EXAMPLE 3—PM No. 3 and IRM No. 1

Example 1 was repeated using a solution of the following composition:

| Solution No. 3 | |
|---|---|
| Distilled water | 100 ml |
| Sodium hydroxide | 2.5 g |
| Potassium bromide | 0.50 g |
| 5-Methylbenzotriazole | 0.050 g |
| Sodium sulfite | 1.0 g |
| Piperidino hexose reductone | 0.45 g |
| HMMP | 0.040 g |

A multicolor reversal dye image with a satisfactory $D_{max}$ was obtained (Red 2.74, Green 2.33, Blue 2.54), but the $D_{min}$ was higher than in Examples 1 and 2 (Red 0.38, Green 0.37, Blue 0.44). This was thought to be due to insufficient piperidino hexose reductone allowing a small amount of cross oxidiation with the RDR's during the first stage of development.

EXAMPLE 4—PM No. 2 and IRM No. 3

These coatings were processed as in Example 1, using the same solution. The receiver contained no ETA. A good reversal dye image was obtained ($D_{min}$ Red 0.37, Green 0.29, Blue 0.25 and $D_{max}$ Red 2.36, Green 2.50, Blue 2.60). This example demonstrates that it is unnecessary to incorporate ETA in the receiver sheet in order to carry out second stage of development.

EXAMPLE 5—PM No. 1 and IRM No. 1

The exposed negative-working photographic element was developed for 2.5 minutes at 29° C. (85° F.) with agitation in a solution of the following composition:

| Solution No. 4 | |
|---|---|
| Distilled water | 100 ml |
| Potassium carbonate | 7.50 g |
| 11-Aminoundecanoic acid | 0.20 g |
| Lysine hydrochloride | 1.00 g |
| Benzyl alcohol | 1.26 g |
| Sodium sulfite | 0.20 g |
| Sodium thiocyanate | 0.10 g |
| Potassium bromide | 0.010 g |
| Ascorbic acid | 0.45 g |
| Catechol | 0.40 g |
| pH to 10.8 (23° C.) with NaOH solution, | |

After lamination in the manner described and light fogging for 40 seconds, the laminate was left for 2.5 minutes at 23° C. Total process time was 5 minutes. On peeling apart a good reversal dye image was obtained ($D_{min}$ Red 0.10, Green 0.16, Blue 0.15 and $D_{max}$ Red 1.27, Green 1.73, Blue 1.61). A trace of negative cyan dye image appeared only in the yellow image areas. The lower cyan $D_{max}$ observed with this process is probably due to alkali depletion under the low pH (10.8) conditions.

The above Examples show that good reversal dye images can be obtained under a variety of conditions and that the presence of a developing agent in the receiver is not essential, although desirable.

EXAMPLE 6—Color Print Paper and Cover Sheet

A cover sheet was prepared by coating a poly(ethylene terephthalate) photographic film base with gelatin at 10.76 g/m$^2$ containing the color developing agent N-ethyl-N-hydroxyethyl-p-phenylenediamine sulfate at 2.69 g/m$^2$, with 624 mg sodium carbonate, 269 mg sodium sulfite and 161 mg BVSME/m$^2$.

A sheet of a conventional negative-working incorporated dye-forming coupler silver halide photographic paper was exposed and processed as in Example 1 using Solution No. 1, but with the sodium hydroxide increased from 2.5 to 3.0 g, and development to 1.5 minutes at 28° C. (82.5° F.) before laminating with a sheet of the above cover sheet coating. After 10 seconds, the laminate was fogged as before, and at a total time of 4 minutes from the start of processing, the laminate was peeled apart. The photographic paper was rinsed, followed by the normal bleach/fix and washing steps. Dye was found only where required to give a good reversal dye image in all colors ($D_{max}$Red 2.58, Green 2.60, Blue 2.60 and $D_{min}$ Red 0.30, Green 0.37, Blue 0.56), showing that the invention can be performed with dye-forming coupling reactions as well as with redox dye-releasers.

EXAMPLE 7—Negative PM No's. 4, 5 and 6 and IRM No. 1

Three negative-working photographic elements were prepared having the following structures:

| |
|---|
| Gelatin (806) |
| RDR (see below), gelatin (3760) |
| unsensitized silver chlorobromide emulsion (860), |
| Gelatin (1610) |
| Antihalation Film Support |

The elements contained the following RDR's:

Magenta RDR 7(a)—535 mg/m$^2$

Cyan RDR 7(b)—565 mg/m$^2$

Yellow RDR 7(c)—460 mg/m$^2$.

All coverages are in mg/m$^2$, as before.

These compounds have the following formulae:

Magenta RDR 7(a)

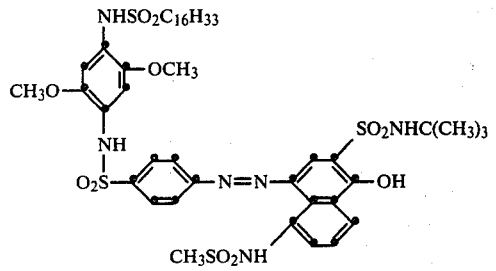

Cyan RDR 7(b)

-continued

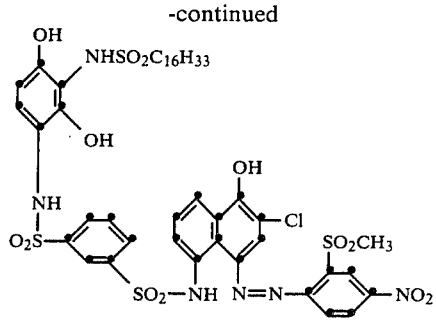

Yellow RDR 7(c)

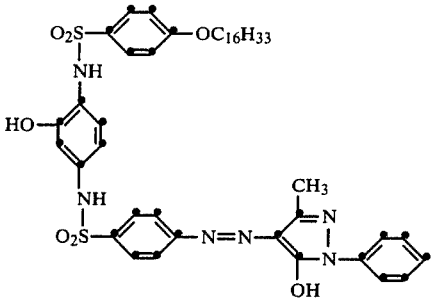

Strips of the negative-working elements were exposed and processed with Solution No. 1 as described in Example 1 with a development time of 1.5 minute at 28° C. (82.5° F.), followed by lamination with a sheet of the receiver. Ten seconds after lamination, the laminate was flashed, as in Example 1, and peeled apart after a further 2 minute 20 seconds at room temperature-i.e., a total time of 4 minutes from the start of processing. Magenta, cyan and yellow positive transferred dye images were obtained on the receiving sheets, showing that other types of negative-working dye image providing compounds can be utilized in the practice of the invention.

These RDR's, particularly the yellow one, are less efficient than the ones used in the earlier Examples. A second strip of each coating was therefore exposed and processed as before until after the fogging exposure. The laminate was then placed on a water heated metal slab at approximately 52° C. (125° F.) and held in contact with it via an insulating cloth for 80 seconds before peeling apart; total processing time was 3 minutes. Similar results were obtained to those of the first strips, and, in the case of the yellow RDR, higher dye densities resulted. This illustrates the fact that, since the second stage of the processing is theoretically to obtain complete development of all unused silver halide, it is useful to thermally drive the reaction to completion. Thus, heating to quite high temperatures gives no deleterious effects, as it would with the usual development of negative or direct-positive silver halide emulsions, but, on the contrary, insures full development and dye transfer in shorter times.

EXAMPLE 8—PM No. 2 and IRM No. 4

As noted above, the processing system of this invention theoretically goes to completion and there is therefore no need to neutralize the alkali to stop development. Since ETA's which are colorless originally and when oxidized can be used, it is in general not necessary to neutralize to prevent stain from oxidized ETA appearing, as in some peel-apart processes employing dye-developers.

However, it can be convenient to reduce the pH to improve image dye stability and/or hue, or to prevent stain in processes reacting dye-forming couplers and color-developing agents in the second stage of development. This can be accomplished by using a receiver incorporating an acid layer and, preferably, a timing layer, below the mordant containing receiving layer. Such acid and timing layers are well known. For the purpose of this Example the following receiver (IRM No. 4) was prepared:

| IRM No. 4 | |
|---|---|
| Layer 4: | Mordant Y (2150), HMMP (160), Hardener (107) |
| Layer 3: | Gelatin nitrate sub (215) |
| Layer 2: | Polymer A (3440), Polymer B (860) |
| Layer 1: | Polymeric Acid (8250), Hardener (415) |
| | Resin-coated Paper |

A strip of the negative PM No. 2 was exposed and processed as in Example 4, using a strip of IRM No. 4 receiver. Results were similar to those obtained in Example 4. The compounds used in the receiver were as follows:

Mordant Y: polyvinylimidazole partially quaternized with chloroethanol,

Hardener: butanediol diglycidyl ether,

Polymer A: a lactonized copolymer of vinyl acetate and maleic anhydride,

Polymer B: a latex polymer of acrylonitrile, vinylidene chloride and acrylic acid, and Polymeric Acid: A 30–70 polymer of butyl acrylate and acrylic acid. This Example illustrates the use of acid and timing layers coated below the mordant layer. It is apparent that alternatively such layers can be coated below the silver halide emulsion layers of the negative-working photographic element to give substantially the same result.

Two multilayer photographic elements were prepared with the following structures:

| PM No. 7 | |
|---|---|
| Layer 9: | Gelatin (600), Scavenger (660), BVSME (99) |
| Layer 8: | Gelatin (2150), Blue-Sensitive Emulsion (900), Antifoggant (0.05 g/mole), Scavenger (160), Yellow RDR(m) (1500), BVSME (32) |
| Layer 7: | No Layer |
| Layer 6: | Gelatin (1200, Scavenger (900), Carey Lea Silver (180), BVSME (18) |
| Layer 5: | Gelatin (1800), Green-sensitive Emulsion (900), Antifoggant (0.1 g/mole, Magenta RDR(o) (900), BVSME (27) |
| Layer 4: | No layer |
| Layer 3: | Gelatin (1200), Scavenger (900), |
| Layer 2: | Gelatin (2000), Red-Sensitive emulsion (900), Antifoggant (0.4 g/mole), Cyan RDR(q) (1200) BVSME (30) |
| Layer 1: | No layer |
| | Antihalation Film Support |

| PM No. 8 | |
|---|---|
| Layer 9: | Gelatin (1075), Scavenger (700), BVSME (8) |
| Layer 8: | Gelatin (1200), Blue-Sensitive Emulsion (500), Antifoggant (0.05 g/mole), Scavenger (29), BVSME (9) |
| Layer 7: | Gelatin (1200), Yellow RDR(n) (550), BVSME (9) |

-continued

| PM No. 8 | |
|---|---|
| Layer 6: | Gelatin (1075), Scavenger (700), Carey Lea Silver (180), BVSME (8) |
| Layer 5: | Gelatin (1200), Green-sensitive Emulsion (530), Antifoggant (0.1 g/mole), BVSME (9) |
| Layer 4: | Gelatin (1200), Magenta RDR(p) (550), BVSME (9) |
| Layer 3: | Gelatin (1075), Scavenger (700), BVSME (8) |
| Layer 2: | Gelatin (1200), Red-Sensitive emulsion (900), Antifoggant (0.4 g/mole), Cyan RDR(q) (400) BVSME (9) |
| Layer 1: | Gelatin (1075), BVSME (8) |
| | Antihalation Film Support |

All coating coverages are expressed in mg/m$^2$, as before. the compounds used in these coatings were as follows:

Yellow RDR(m)

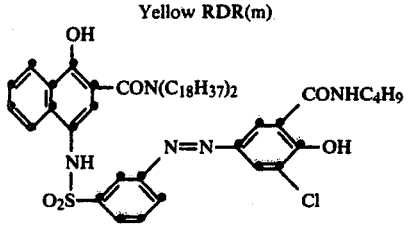

Yellow RDR(n)

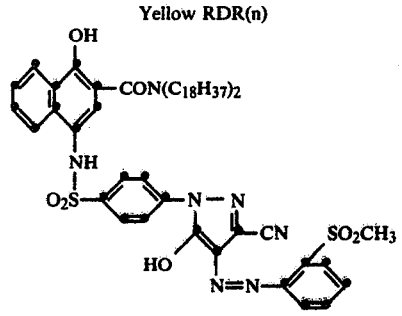

Magenta RDR(o)

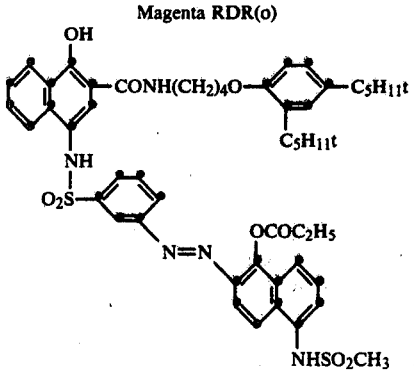

Magenta RDR(p)

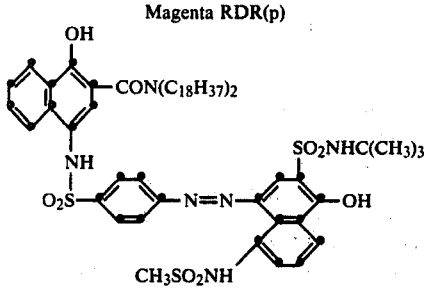

-continued

Cyan RDR(q)

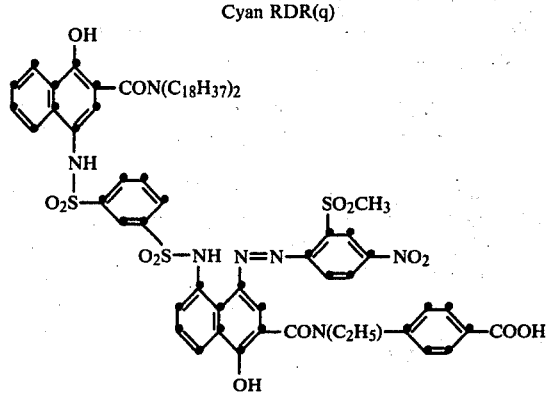

The other components have already been detailed in earlier Examples.

In all cases the RDR's were incorporated in the coatings as dispersions in a conventional coupler solvent.

The above-described coatings were used in the following Examples.

EXAMPLE 9—PM No. 7 and IRM No. 5

A mordant layer coating IRM No. 5 was prepared with the following structure:

| |
|---|
| Gelatin (5400), Mordant X (5400), BVSME (77) |
| Clear Film Support |

A sheet of the negative-working photographic element PM No. 7 was exposed and developed for 3.5 minutes at 28° C. (82.5° F.) with agitation in the following solution:

| Solution No. 5 | | |
|---|---|---|
| Distilled water | 100 | ml |
| Sodium hydroxide | 2.5 | g |
| Potassium bromide | 0.5 | g |
| 5-Methylbenzotriazole | 0.05 | g |
| Sodium sulfite | 5.0 | g |
| Glycin | 0.7 | g |
| HMMP | 0.06 | g |
| 11-Aminoundecanoic acid | 0.15 | g |

The element was then laminated as before with a sheet of the receiver IRM No. 5, flashed as before, and left for a total time of 8 minutes from the start of processing. On peeling apart, a good reversal dye transparency ($D_{max}$ Red 2.84, Green 2.60, Blue 3.00 and $D_{min}$ Red 0.38, Green 0.30, Blue 0.39) was obtained. This example shows the application of the invention to the preparation of positive images of high densities without deleterious effects.

EXAMPLE 10—Negative PM No. 8 and IRM No. 6

A receiver of the general type used in the production of integral instant prints was employed of the following structure:

| IRM NO. 6 | |
|---|---|
| Layer 3: | Carbon (2680), Gelatin (1670) |
| Layer 2: | $TiO_2$ (21500), Gelatin (2150) |
| Layer 1: | Mordant Z (2150), Gelatin (2150) |

-continued

| IRM NO. 6 |
|---|
| Clear Film Support |

The gelatin in all layers was hardened by the addition of 0.75 percent BVSME, based on the weight of the gelatin.

Mordant Z is copoly[styrene-(N,N-dimethyl-N-benzyl-N-maleimido propyl)ammonium chloride].

Using this receiver as substrate, a layer of extra silver halide was prepared by coating a silver chloride emulsion at a coverage of 1250 mg Ag/m$^2$ and 1600 mg gelatin/m$^2$, again hardened with BVSME at 0.75 percent gelatin weight.

A processing solution No. 6 was prepared as follows:

| Solution No. 6 | |
|---|---|
| Distilled water | 100 ml |
| Sodium hydroxide | 6.0 g |
| Potassium bromide | 0.5 g |
| 5-Methylbenzotriazole | 0.05 g |
| t-Butylhydroquinone | 0.44 g |
| HMMP | 0.20 g |
| Sodium sulfite | 1.0 g |
| Hydroxyethyl cellulose | 2.8 g |

A sheet of PM No. 8 was imagewise exposed and in the dark, laminated with a sheet of the emulsion coated receiver IRM No. 6, spreading the goo between them by means of a pair of nip rollers, one of which was undercut to give a roller gap of 125 microns (0.005 in.). After 1.5 minutes the laminate was exposed from the receiver and left in normal room light. After 4 minutes a positive, reversal dye image was present in the mordant layer of the receiver.

The strips prepared as above were peeled apart and rinsed for stability.

This Example illustrates the use, to deplete the competing oxidizable substance t-butylhydroquinone, of an extra silver halide layer which enables this invention to operate with no change in conditions whatever between the first and second development stages. Not only is a single solution employed, but lamination takes place at the start of the processing cycle. The principles demonstrated by this Example can be applied to integral in-camera instant photographic image transfer systems.

The invention has been described in detail with reference to certain preferred embodiments thereof, but it will be understood that variations can be effected within the spirit and scope of the invention.

What is claimed is:

1. A method of producing a reversal dye image by photographically processing an imagewise exposed photographic element containing at least one negative-working silver halide emulsion layer, said method comprising contacting the photographic element with an alkaline processing composition, at least one of the alkaline processing composition and the photographic element containing an electron transfer agent which is oxidized in developing exposed silver halide, a dye image providing compound and a competing oxidizable substance which is capable of being cross-oxidized by the oxidized electron transfer agent in preference to the dye image providing compound to prevent oxidation of the dye image providing compound, the competing oxidizable substance being present in an amount sufficient to regenerate substantially all of the electron transfer agent oxidized by development of imagewise exposed silver halide, developing silver halide remaining which was not imagewise exposed with the electron transfer agent to produce additional oxidized electron transfer agent, depleting the competing oxidizable substance remaining without depleting the oxidized electron transfer agent and image providing compound to produce a reversal dye image.

2. A method according to claim 1 in which the silver halide photographic element is heated to accelerate development of the remaining silver halide.

3. A method according to claim 1 in which the silver halide photographic element is fogged when development of the imagewise exposed silver halide is substantially completed to permit accelerated development of the remaining silver halide.

4. A method according to claim 1 in which the photographic element is laminated to a separate element after development of the imagewise exposed silver halide is substantially completed.

5. A method according to claim 4 in which the separate element is a receiver containing a mordant layer and the dye image providing compound, in response to the imagewise distribution of oxidized electron transfer agent present after depletion of the competing oxidizable substance, releases to the receiver a dye or dye precursor to form in the receiver a transferred dye image.

6. A method according to claim 5 in which the dye image providing compound is negative-working and the transferred dye image is positive.

7. A method according to claim 4 in which the separate element contains a color-developing agent as the dye image providing compound and development of the remaining silver halide occurs in the presence of a dye-forming coupler.

8. A method according to claim 1 in which during development of the remaining silver halide a color-developing agent and a dye-forming coupler are present so that, after competing oxidizable substance has been depleted, oxidized electron transfer agent cross-oxidizes the color-developing agent which then reacts with the dye-forming coupler to form a positive, reversal dye image.

9. A method according to claim 1 in which the electron transfer agent is chosen from the class consisting of 1-phenyl-3-pyrazolidinone, p-aminophenol, catechol and p-phenylenediamine developing agents.

10. A method of producing a reversal dye image by photographically processing an imagewise exposed photographic element containing at least one negative-working silver halide emulsion layer, said method comprising contacting the photographic element with an alkaline processing composition, at least one of the alkaline processing composition and the photographic element containing an electron transfer agent which is oxidized in developing exposed silver halide, a dye image providing compound, and a competing oxidizable substance chosen from the class consisting of ascorbic acid, piperidino hexose reductone, glycin and hydroquinone developing agents, the competing oxidizable substance being present in an amount sufficient to regenerate substantially all of the electron transfer agent oxidized by development of imagewise exposed silver halide, developing silver halide remaining which was not imagewise exposed with the electron transfer agent to produce additional oxidized electron transfer agent, depleting the competing oxidizable substance remaining without depleting the oxidized electron transfer agent and reacting oxidized electron transfer agent with the dye image providing compound to produce a reversal dye image.

11. A method according to claim 1 in which the dye image providing compound is a reducing agent and is cross-oxidized by oxidized electron transfer agent in the absence of the competing oxidizable substance.

12. A method according to claim 11 in which the dye image providing compound is a negative-working redox dye-releaser.

13. A method of producing a reversal dye image by photographically processing a negative-working imagewise exposed photographic element having a support bearing three superimposed dye image-forming layer units, adjacent layer units being separated by an oxidized electron transfer agent scavenger-containing layer, a first of the layer units containing a negative-working blue-sensitized silver halide emulsion layer and an immobile, yellow dye image providing redox dye-releaser, a second of the layer units containing a negative-working green-sensitized silver halide emulsion layer and an immobile, magenta dye image providing redox dye-releaser, and a third of the layer units containing a negative-working red-sensitized silver halide emulsion layer and an immobile, cyan dye image providing redox dye-releaser, said method comprising (a) developing imagewise exposed silver halide in the emulsion layers with a 1-phenyl-3-pyrazolidinone electron transfer agent in the presence of a competing oxidizable substance chosen from the class consisting of ascorbic acid, piperidino hexose reductone, glycin, and hydroquinone developing agents, the competing oxidizable substance being present in an amount sufficient to cross-oxidize substantially all of the electron transfer agent which becomes oxidized in developing the exposed silver halide, so that the oxidized electron transfer agent is prevented from cross-oxidizing the redox dye-releasers, (b) fogging silver halide remaining undeveloped, (c) developing the remaining silver halide with the electron transfer agent to generate oxidized electron transfer agent in an amount sufficient to cross-oxidize the competing oxidizable substance remaining unoxidized and to cross-oxidize the redox dye-releasers, so that mobile image dyes are released, and (d) transferring the mobile image dyes to an image-receiving means for viewing.

14. A method according to claim 13 in which the competing oxidizable substance is replenished during development of imagewise exposed silver halide and the competing oxidizable substance is not replenished during development of the remaining silver halide after fogging.

15. A method according to claim 13 in which a portion of the electron transfer agent is initially incorporated in the image-receiving means.

16. A method according to claim 13 in which additional silver halide which, when fogged, develops at a faster rate than silver halide present in the dye image forming layer units is present in a layer separated from the dye image forming layer units by an oxidized electron transfer agent scavenger containing layer, the additional silver halide being fogged during fogging of the silver halide remaining undeveloped, and the additional silver halide being developed during development of the remaining silver halide to produce oxidized electron transfer agent which cross-oxidizes and substantially depletes the competing oxidizable substance remaining, and the oxidized electron transfer agent generated by development of the additional silver halide being prevented from cross-oxidizing the redox dye releasers by the scavenger layer separating the extra silver halide from the dye image providing layer units.

17. A method of producing a reversal dye image by photographically processing a negative-working imagewise exposed photographic element having a support bearing three superimposed dye image forming layer units, adjacent of the layer units being separated by an oxidized developing agent scavenger containing layer, a first of the layer units containing a negative-working blue-sensitized silver halide emulsion and a ballasted yellow dye-forming coupler, and a second of the layer units containing a negative-working green-sensitized silver halide emulsion layer and a ballasted magenta dye-forming coupler, and a third of the layer units containing a negative-working red-sensitized silver halide emulsion layer and a ballasted cyan dye-forming coupler, said process comprising (a) developing imagewise exposed silver halide in the emulsion layers in the absence of color-developing agent with a 1-phenyl-3-pyrazolidinone electron transfer agent in the presence of a competing oxidizable substance chosen from the class consisting of ascorbic acid, piperidino hexose reductone, glycin, and hydroquinone developing agents, the competing oxidizable substance being present in an amount sufficient to cross-oxidize substantially all of the electron transfer agent which becomes oxidized in developing the exposed silver halide, (b) laminating a covering sheet bearing a color-developing agent containing layer to the photographic element and fogging silver halide remaining undeveloped, and (c) developing the remaining silver halide with the electron transfer agent to generate oxidized electron transfer agent in an amount sufficient to cross-oxidize the competing oxidizable substance remaining unoxidized and to cross-oxidize the color-developing agent so that the latter can react with the dye-forming couplers to form a dye image.

18. In an image transfer film unit capable of producing a transferred dye image when imagewise exposed and photographically processed with an alkaline processing composition, said film unit comprising a photographic element having a support, a negative-working silver halide emulsion imaging layer on said support and, associated with said emulsion layer, an initially immobile negative-working dye image providing compound capable of providing a mobile dye image, an image-receiving means positioned to receive mobile image dye from said photographic element and an electron transfer agent located to develop silver halide and thereby produce oxidized electron transfer agent during processing, the improvement comprising a competing oxidizable substance which is capable of being preferentially cross-oxidized by oxidized electron transfer agent to prevent oxidation of the dye image providing compound, the competing oxidizable substance being located to contact the oxidized electron transfer agent and being present in an amount sufficient to regenerate substantially all of the electron transfer agent oxidized by development of imagewise exposed silver halide, a layer containing additional silver halide which, when fogged, develops at a faster rate than silver halide present in said silver halide emulsion imaging layer, said additional silver halide being present in an amount sufficient to permit oxidized electron transfer agent produced by development of said additional silver halide to deplete by cross-oxidation said competing oxidizable substance and a processing composition permeable layer containing an oxidized electron transfer agent scavenger separating said additional silver halide from said immobile dye image providing compound, so that mobile image dye is produced selectively by development of imagewise unexposed silver halide in said silver halide emulsion imaging layer following depletion of said competing oxidizable substance to produce a positive transferred dye image in said image-receiving means.

19. In an image transfer film unit capable of producing a transferred dye image which comprises a photographic element comprising a support, at least one negative-working silver halide emulsion imaging layer coated on said support, and an initially immobile negative-working dye image providing redox dye-releaser in said emulsion layer or a layer adjacent thereto, an image-receiving means including a mordant containing layer positioned to receive mobile image dye from said photographic element, an alkaline processing composition, means containing and adapted to release said alkaline processing composition for contact with said emulsion layer, and 1-phenyl-3-pyrazolidinone electron transfer agent capable of developing imagewise exposed silver halide in said emulsion imaging layer located in at least one of said photographic element and said alkaline processing composition, the improvement comprising a competing oxidizable substance chosen from the class consisting of ascorbic acid, piperidino hexose reductone, glycin and hydroquinone developing agents, located in at least one of said photographic element and said processing composition capable of being cross-oxidized by oxidized electron transfer agent formed by development of silver halide so that, in the presence of said competing oxidizable substance, liberation of mobile dye by the dye image providing redox dye-releaser is substantially prevented, a layer containing additional silver halide which, when fogged, develops at a faster rate than silver halide present in said silver halide emulsion imaging layer, said additional silver halide being present in an amount sufficient to permit oxidized electron transfer agent produced by its development to deplete by cross-oxidation the competing oxidizable substance and a processing composition permeable layer containing an oxidized electron transfer agent scavenger separating said additional silver halide layer from said dye image providing redox dye-releaser, so that oxidized electron transfer agent formed in said additional silver halide layer is prevented from reacting with said dye image providing compound to liberate mobile dye and mobile dye is liberated selectively by development of imagewise unexposed silver halide in said silver halide emulsion imaging layer following depletion of said competing oxidizable substance to produce a positive transferred dye image in said image-receiving means.

20. In an improved image transfer film unit according to claim 18 or 19, said photographic element being comprised of three superimposed dye image forming layer units, adjacent of said layer units being separated by an oxidized electron transfer agent scavenger containing layer, a first of said layer units containing a negative-working blue-sensitized silver halide emulsion imaging layer and an immobile, yellow dye image providing redox dye-releaser, a second of said layer units containing a negative-working green-sensitized silver halide emulsion imaging layer and an immobile, magenta dye image providing redox dye-releaser, and a third of said layer units containing a negative-working red-sensitized silver halide emulsion imaging layer and an immobile, cyan dye image providing redox dye-releaser.

* * * * *